US005404961A

United States Patent [19]

Huber

[11] Patent Number: 5,404,961

[45] Date of Patent: Apr. 11, 1995

[54] POWER STEERING SYSTEM INCLUDING PISTON DAMPING MECHANISM

[75] Inventor: Gerhard Huber, Kaltental, Germany

[73] Assignee: Hoerbiger Ventilwerke Aktiengesellschaft, Vienna, Austria

[21] Appl. No.: 191,544

[22] Filed: Feb. 4, 1994

[30] Foreign Application Priority Data

Feb. 9, 1993 [AT] Austria ..... 233/93

[51] Int. Cl.[6] ..... B62D 5/06

[52] U.S. Cl. ..... 180/132; 114/144 R; 114/150; 440/61; 440/63

[58] Field of Search ..... 180/79, 132, 141, 79.3, 180/79.4; 440/63, 61; 114/144 R, 150

[56] References Cited

U.S. PATENT DOCUMENTS 4,744,777 5/1988 Ferguson ..... 440/63
4,892,494 1/1990 Ferguson ..... 440/63
5,188,051 2/1993 Huber ..... 114/150

*Primary Examiner*—Mitchell J. Hill
*Attorney, Agent, or Firm*—Watson, Cole, Grindle & Watson

[57] ABSTRACT

A power steering system (3) includes a controller (1) and a control mechanism (3), which can be operated by way of a Bowden cable (5) having a core (7) and a sheath (6). The core (7) is connected directly mechanically to the control mechanism (3), and the sheath (6) is connected hydraulically to the control mechanism (3) by way of a control valve (8) and an operating cylinder (9). To prevent oscillations in the closed control circuit of the power steering system, the sheath (6), or the control piston (15) of the control valve (8) connected thereto, is provided with a damping device (18) to dampen the axial movement of the control piston (15). The damping device provides hydraulic damping of the control piston (15).

7 Claims, 2 Drawing Sheets

6
5
1
17
16
7a
15
20
35
28
30
27
12
8
29
26
32
10
31
34
22
9
39
18
24
19
33
24
39
40
4
II
20
2
11
7b
13
7
14
3
25
4

POWER STEERING SYSTEM INCLUDING PISTON DAMPING MECHANISM

FIELD OF THE INVENTION

The present invention relates to a power steering system for motor vehicles, in particular motor boats, with a controller and a control mechanism, which can be actuated by way of a Bowden cable having a core and a sheath. The core is connected directly mechanically to the control mechanism and the sheath is connected hydraulically to the control mechanism by way of a control valve and an operating cylinder.

BACKGROUND OF THE INVENTION

Such systems are known, for example, from U.S. Pat. No. 4,295,833 or German publication DE-A1 40 39 425 and are employed, for example, in motor boats which exhibit high output and are difficult to steer without the hydraulic power assist. At the same time, the principle of force-balance is utilized, wherein, when the controller is actuated, not only is a torque exerted on the controlling mechanism by way of the existing mechanical connection of the core of the Bowden cable, but also a pressure medium connection is also simultaneously steered to or from the respective desired working chamber of the operating cylinder. Thus, the steering force exerted at the controller or the steering wheel is intensified in the requisite direction. The control valve is operated by means of the resulting deformation of the Bowden cable. When, following completed adjustment of the control mechanism, the deformation of the Bowden cable is cancelled again by way of the controller, the control valve returns into its central position, and adjustment of the control mechanism is thus concluded again. One particular example of actuating a controller is the manual operation of a steering wheel or the like.

One drawback of the known systems of the aforementioned kind is based in particular on the fact that such power steering systems represent closed control circuits, which tend to vibrate a lot owing to unavoidable tolerances or play in the Bowden cable, the bolts, and the like, a feature that can cause problems while steering.

SUMMARY OF THE INVENTION

It is an object of the present invention to improve a power steering system of the aforementioned kind in such a manner that the cited drawbacks of such known systems are avoided and that in particular the control circuit of the hydraulic steering reinforcement is prevented from vibrating, with simple means.

The problem with a system of the aforementioned kind is solved according to the present invention in that the sheath or the control piston of the control valve connected thereto exhibits a damping device to dampen the axial movement of the control piston. If at this stage the power steering is set into oscillation as described above by means of a disturbing force or other circumstances, and thus the control piston of the control valve is axially deflected, this deflection is damped in both possible directions of movement by means of the damping device of the present invention. Thus, the control piston and the hydraulics of the power steering are again in the central or neutral position within a minimum period of time. For this purpose, it would also be possible to build into the supply and discharge channels of the hydraulic operating cylinder suitable throttles, which dampen hydraulically the movement of the operating piston. Even though this kind of damping is very effective, it is relatively expensive to produce, assemble and maintain and, therefore, not suitable for all applications. However, the solution according to the present invention has a direct effect on the movement of the control piston in a manner that is relatively simple to accomplish.

Another embodiment of the invention provides that the damping device exhibits a damping piston, which is mounted stationarily on the sheath or the control piston and which dips into one of two oil filled damping chambers provided on both sides of the damping piston for the purpose of hydraulic damping. The result is an especially simple method for damping the movement of the control piston, which also functions without wear and virtually without maintenance.

In the latter context, another embodiment of the invention is especially advantageous wherein the damping piston exhibits, on both sides of the central position of the sheath or the control piston, a free undamped distance as far as the damping immersion into the respective damping chamber. Thus, rapid compensating movements can be undamped in the region of the central position of the hydraulic components of the power steering system, a feature that can be utilized, for example, to steer rapidly against feedback from the control mechanism. Furthermore, these undamped distances also make it possible to supply in a relatively simple manner the damping chambers with oil or hydraulic medium even during the initial startup of the power steering system.

According to another variation of the invention, the control piston can have a milled slot, connected to the two damping chambers by way of an annulus in the central position of the control piston. This measure guarantees that the damping chambers will be reliably fed with oil.

However, according to another preferred embodiment of the invention, the damping chambers can also be supplied with hydraulic medium by way of separate boreholes or channels, whereby then the cited free distances or the corresponding negative undercuts for filling the damping chambers with oil are no longer indispensable. dr

BRIEF DESCRIPTION OF THE DRAWINGS

The invention is explained in detail with reference to the following description of the embodiments depicted diagrammatically in the drawings, wherein.

DETAILED DESCRIPTION OF THE INVENTION

Figure 1:
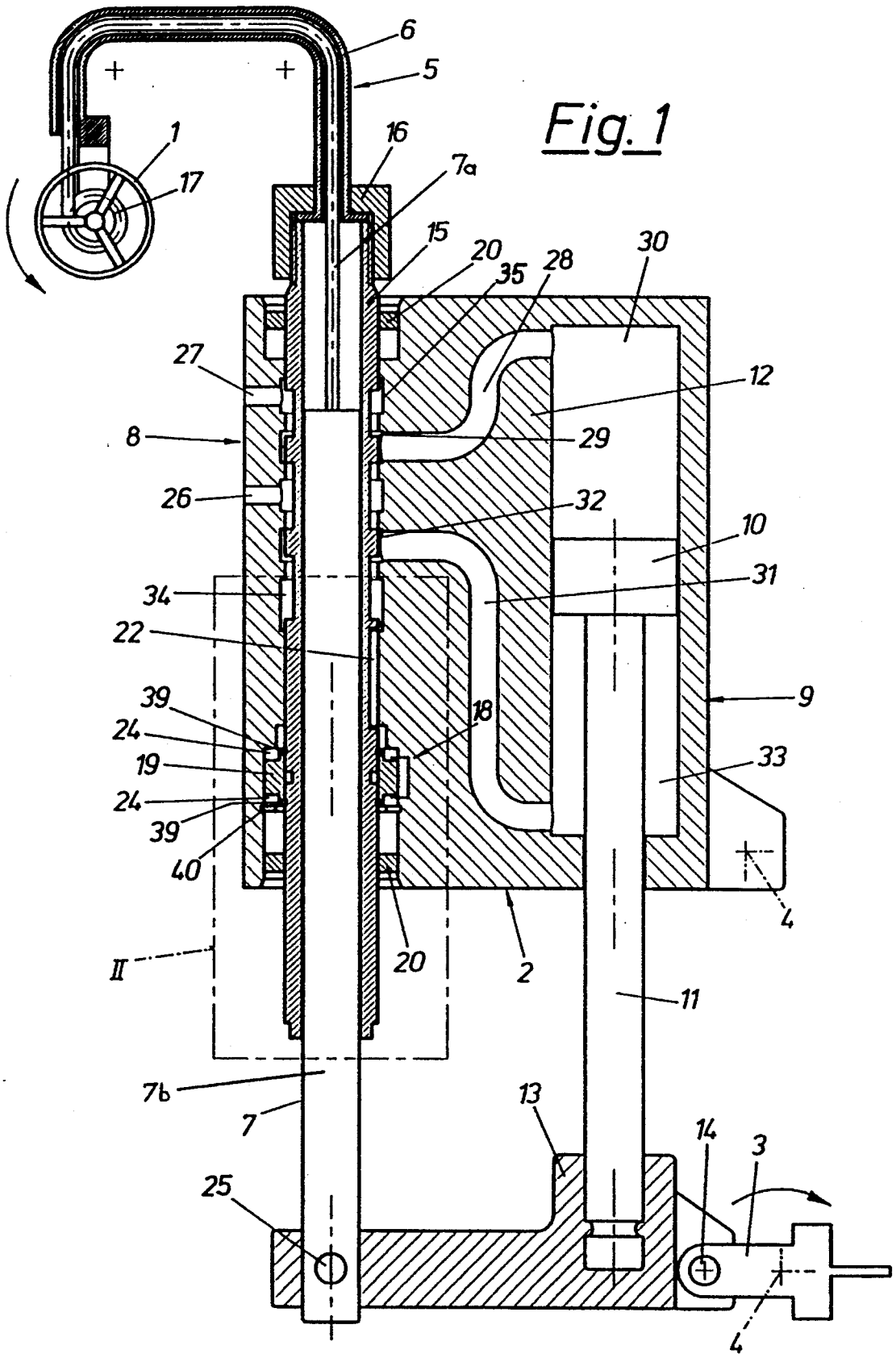
FIG. 1 is a cross sectional view of a power steering system according to the present invention.

The power steering system depicted diagrammatically in FIG. 1 comprises, in essence, a steering wheel 1 serving as the controller, a component 2 to support the hydraulic steering, and a control mechanism 3, for example, the rudder or the so-called Z drive of a motor boat. Apart from that, the control mechanism 3 could, of course, also be integrated into the steering of a land vehicle or be acting on the steering. In the illustrated embodiment both the control mechanism 3 and the component 2 can be swivelled around an axle 4 mounted stationarily, for example, in the boat body of a motor boat (not shown in detail).

The steering wheel 1 is also anchored stationarily at the boat body in a manner that is also not illustrated in detail. From the steering wheel 1, a Bowden cable 5, which exhibits a sheath 6 and a core 7, runs to the component 2 which consists in essence of a control valve 8 and an operating cylinder 9. The core comprises a portion *7a* which is partially surrounded by the sheath 6 and a portion *7b* which is partially surrounded by a sleeve piston 15. A piston operator 10 and the corresponding piston rod 11 are arranged in the operating cylinder 9. The piston rod 11 is guided sealingly to the outside through the housing 12 in a manner that is not shown in detail here, and connected to a lever 13. The lever 13 is in turn connected to the control mechanism 3 by way of a bolt 14.

The piston 15 housed in the valve housing 12 and belonging to the control valve 8 is designed here as a slider or sleeve piston and is connected to the sheath 6 of the Bowden cable 5 by way of a threaded nut 16.

The piston 15 is sealed with a seal 20 toward the outside on the upper and bottom side as seen in the drawing. A bolt 25 also connects the lever 13 to the core portion *7b* and produces thus a rigid connection between core 7, lever 13, and piston rod 11.

The housing 12 is provided with the necessary ports for a pressure medium pump 26 and a port 27 leading to a tank that is not shown in detail. The annulus 29 is connected by means of a channel 28 to the cylinder chamber 30, which is designed on the side of the operating cylinder 9 facing away from the piston rod 11. Another channel 31 in turn connects the annulus 32 at the control valve 8 to the cylinder chamber 33 on the side of the operating cylinder 9 facing toward the piston rod 11. The two annuluses 34 and 35 for the tank port are connected together by way of a borehole (not illustrated here).

The illustrated power steering functions according to the principle of force-balance. By operating the steering wheel 1 a torque is exerted on the control mechanism 3 not only by way of the existing mechanical connection through the core 7, but the pressure medium supply and discharge to and from the desired cylinder chamber 30 or 33 is also controlled at the same time so as to intensify the steering force in the desired direction. In so doing, the piston 15 of the control valve 8 is operated by means of a deformation of the Bowden cable 5. When following completed adjustment of the control mechanism 3, the deformation of the Bowden cable 5 is cancelled, the piston 15 returns again into its central position, thus concluding the adjustment of the control mechanism 3.

In the central position of the piston 15 the two cylinder chambers 30 or 33 are connected without pressure to the tank port 27 by means of the two channels 28 and 31 and the annuluses 34 and 35.

The power steering is operated by means of the Bowden cable 5 in the following manner. When the steering wheel 1 is rotated counterclockwise to the left, the core 7 of the Bowden cable responds to pull, whereby a force is exerted in the "move-in" direction on the operating piston by way of the bolt 25, the lever 13 and the piston rod 11. Similarly the control mechanism 3 moves clockwise into the desired direction of rotation. Between the rigid portion *7b* of the core and the sleeve piston 15 that is directly connected to the sheath 6 of the Bowden cable, there is a frictional force that takes along the piston 15 in the respective direction of movement of the core. Likewise, the sheath 6 is also moved in the respective direction of movement of the core because of its direct connection to the piston 15. As the sheath is forced toward or away from the steering wheel, depending upon the direction of rotation of the steering wheel, the sheath becomes deformed relative to its non-deformed central position. At this stage the core *7a* of the Bowden cable 5 tries to occupy an elongated position within the sheath 6, whereby the sheath 6 adapts to this elongated position and moves the piston 15 downward in the drawings. In this position the pressure medium port 26 is connected by way of the annulus 36, the channel 31 and the cylinder chamber 33. Similarly, the cylinder chamber is connected to the tank port 27. The result is that the pressure medium flowing into the cylinder chamber 33 adjust the operating piston 11 also in the "move-in" direction. The power steering system is operated as desired with the aid of the operating cylinder 9. Following completed adjustment of the control mechanism 3, the deformation of the Bowden cable is cancelled. The sheath returns to its central position so as to relieve the stress caused by its deformation, thus concluding the adjustment of the control mechanism 3.

When the steering wheel 1 is moved clockwise, the directions of movement described above have only to be reversed, thus adjusting the operating piston 10 in the "move-out" position.

As one can infer from the above description of the power steering system, it involves a closed control circuit. Since play cannot be avoided, for example, in the Bowden cable 5, in the steering gear 17, in the bolts 25 and 14, etc., for design reasons, this control circuit tends to oscillate under various circumstances. These oscillations reduce the manipulability and general usefulness of the power steering system. To remedy this drawback, it is provided that the sheath 6 or the control piston 15 of the control valve 8 that is connected thereto exhibits a damping device 18 to dampen the axial movement of the control piston 15. For this purpose the damping device 18 has a damping piston 19, which is mounted stationarily on the control piston 15 and which dips into one of two oil-filled damping chambers 24 provided on both sides of the damping piston. The damping piston 19 has on both sides of the central position of the sheath 6 or the control piston 15 a free undamped distance as far as the damping immersion into the respective damping chamber 24, so that a free undamped mobility of the control piston 15 is produced directly around the central position.

Figure 2:
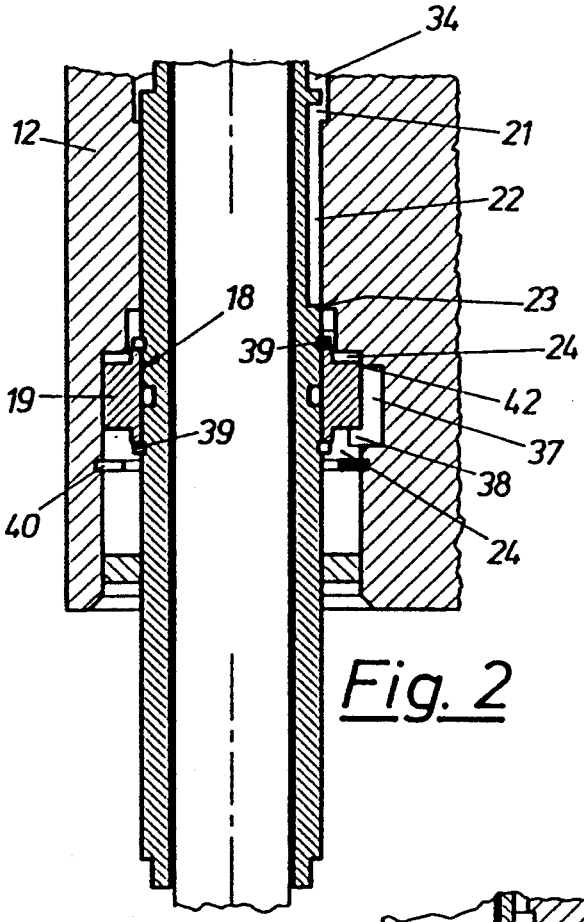
FIGS. 2 and 3 depict an enlarged detail II from FIG. 1 with the power steering system in different positions.
Figure 3:
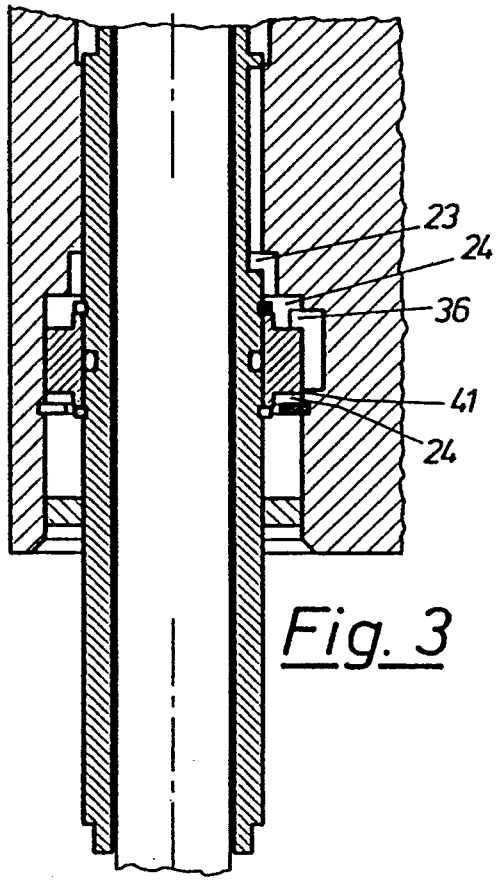

Since at the start of a trip with a motor boat equipped with such a power steering system, the damping chambers 24 are possibly not filled with hydraulic oil, the embodiment shown in FIG. 1 to 3 has a connection as far as the damping chamber 34, shown at the bottom of the drawing, starting from the annulus 34 by way of a negative overlap 21, milled slot 22 (in the control piston 15), a negative overlap 23 in the damping chamber 34, another negative overlap 36, a milled slot 37 in the housing 12 and the negative overlap 38. The damping chamber ensures that the damping device 18 is supplied reliably with hydraulic oil.

In the illustrated embodiment a shape-locking connection is produced by way of retaining rings 39 between control piston 15 and damping piston 19. The interaction between the damping piston 19 and the corresponding shoulder at the housing 12 serves toward the top as the stop for the possible movement of the control piston 15. Toward the bottom, the damping piston 19 waits at an inserted ring 40 at the end of the allowable movement of the control piston 15.

The illustrated power steering unit may begin oscillating by means of a disturbing force or other circumstances. In so doing, the control piston 15 may be deflected, for example, to the bottom in the drawing. The deflection in the undamped state, starting from the central position shown in FIG. 1, is possible only until the short negative overlap 38 is driven over, a shown in FIG. 3. Thereafter, the oil has to flow in the assigned, bottom damping chamber 24 via gap 41, thus hydraulically damping the control piston 15 and stabilizing the power steering system.

When the control piston is deflected to the top in the drawing (according to FIG. 2), the damping piston 19 first travels over the negative overlap 36, whereby the negative overlap at 23 also closes. Thus, the corresponding damping chamber 24 is blocked and the hydraulic oil is forced to flow over the gap 42. In this manner, too, the control piston 15 and the entire power steering system is correspondingly hydraulically damped.

Besides ensuring that the damping chambers 24 are filled with oil, the negative overlaps can also have the task, when there are short and sudden reactive forces starting from the control mechanism 3, of enabling short, undamped and thus rapid reaction movements of the control piston 15, in order to compensate for these reactive forces.

Figure 4:
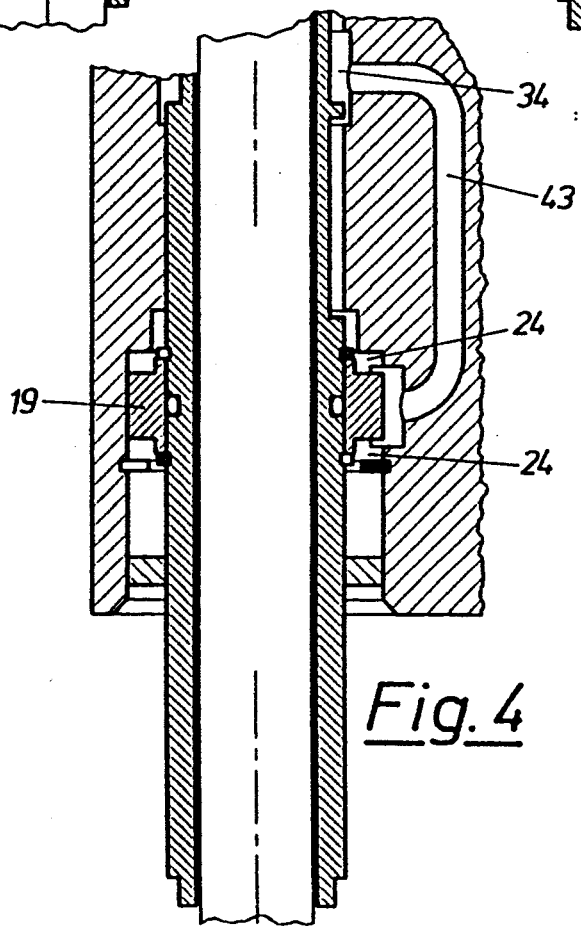
FIG. 4 depicts a detail corresponding to that shown in FIGS. 2 and 3 but of another embodiment of the present invention.

The major distinction between the other design depicted in FIG. 4 and the previous ones lies in the fact that here the damping chambers 24 are filled with hydraulic oil, fed from the annulus 34, by way of a separate borehole or a channel 43. With respect to the other features and advantages of the design according to FIG. 4, reference is made only explicitly to the aforementioned statements concerning the system according to FIGS. 1 to 3, in order to avoid repetition.

Apart from the illustrated and described hydraulic damping of the control piston 15, the damping device 18 could, of course, also be designed in a different, suitable, and known manner. Thus, for example a friction damping or the like would be possible provided only undesired oscillations were suppressed altogether in the movement of the control piston or the power steering.

Although the present invention has been described in connection with preferred embodiments, it will be appreciated by those skilled in the art that additions, modifications, substitutions and deletions not specifically described may be made without departing from the spirit and scope of the invention defined in the appended claims.

What is claimed is:

1. A power steering system for a motor vehicle, said system including a direction control means for determining a direction of movement of the motor vehicle, a steering means, a cable core connected between said steering means and said direction control means for moving said direction control means in opposite first and second directions to thereby determine the direction of movement of the motor vehicle, a control valve having a body portion including a sleeve piston disposed therein and axially moveable from a central position within said control valve, said sleeve piston surrounding a first length of said cable core, a cable sheath surrounding a second length of said cable core and connected to said sleeve piston, an operating cylinder disposed within said control valve and connected to said direction control means to hydraulically assist said cable in moving said direction control means in one of said first and second directions, and a damping piston disposed on said sleeve piston for axial movement therewith, said body portion further including a first hydraulic medium-filled damping chamber formed therein on a first side of and adjacent said damping piston for inhibiting axial movement of said sleeve piston from said central position toward said first damping chamber, and a reservoir in communication with said first damping chamber during an initial axial movement of said damping piston toward said first damping chamber, said reservoir receiving hydraulic medium expelled from said first damping chamber during said initial axial movement of said sleeve piston toward said first damping chamber, wherein the communication between said first damping chamber and said reservoir is interrupted by said damping piston after said damping piston travels a first distance away from said central position toward said first damping chamber thus preventing further expulsion of hydraulic medium from said first damping chamber and providing undamped axial movement of said sleeve piston toward said first damping chamber before a dampening effect is provided.

2. A power steering system as claimed in claim 1, further including a second hydraulic medium-filled damping chamber formed in said body portion on a second side of said damping piston opposite said first side and adjacent said damping piston for inhibiting axial movement of said sleeve piston from said central position toward said second damping chamber, said reservoir also being in communication with said second damping chamber during an initial axial movement of said damping piston toward said second damping chamber, said reservoir receiving hydraulic medium expelled from said second damping chamber during said initial axial movement of said sleeve piston toward said second damping chamber, wherein the communication between said second damping chamber and said reservoir is interrupted by said damping piston after said damping piston travels a second distance away from said central position toward said second damping chamber thus preventing further expulsion of hydraulic medium from said second damping chamber and providing undamped axial movement of said sleeve piston toward said second damping chamber before a dampening effect is provided.

3. A power steering system as claimed in claim 2, wherein said first and second damping chambers are connected to a channel for the supply of hydraulic medium thereto.

4. A power steering system as claimed in claim 1, wherein said damping piston surrounds said sleeve piston.

5. A power steering system as claimed in claim 1, wherein said first damping chamber is connected to a channel for the supply of hydraulic medium thereto.

6. A power steering system as claimed in claim 1, wherein said sleeve piston has first and second opposite ends, the first end is connected to said sheath, and the damping piston is disposed closer to said second end than to said first end.

7. A power steering system as claimed in claim 1, wherein said sleeve piston has first and second opposite ends, the first end is connected to said sheath, and the second end extends outwardly of the control valve.

* * * * *